US007658306B2

(12) United States Patent
Allen et al.

(10) Patent No.: US 7,658,306 B2
(45) Date of Patent: Feb. 9, 2010

(54) DRINK POURING DISPENSER

(75) Inventors: Scott Allen, Crows Nest (AU); Kenneth George Bonham, Crows Nest (AU); Michael Henry Silvers, Crows Nest (AU); Sam Tam, Crows Nest (AU)

(73) Assignee: Howard Silvers & Sons Pty Limited, Ultimo, NSW (AU)

( * ) Notice: Subject to any disclaimer, the term of this patent is extended or adjusted under 35 U.S.C. 154(b) by 0 days.

(21) Appl. No.: 12/406,058

(22) Filed: Mar. 17, 2009

(65) Prior Publication Data

US 2009/0179052 A1 Jul. 16, 2009

Related U.S. Application Data

(63) Continuation of application No. 11/098,180, filed on Apr. 4, 2005, now Pat. No. 7,527,180.

(30) Foreign Application Priority Data

Apr. 2, 2004 (AU) ..... 2004901795

(51) Int. Cl.
*B67D 3/00* (2006.01)

(52) U.S. Cl. ..... 222/481.5; 222/566

(58) Field of Classification Search ..... 222/481.5, 222/566–572, 497; 220/711, 717
See application file for complete search history.

(56) References Cited

U.S. PATENT DOCUMENTS

| | | | |
|---|---|---|---|
| 1,151,997 | A | 8/1915 | Beck et al |
| D56,108 | S | 8/1920 | Rustant |
| D142,197 | S | 8/1945 | Swanson et al. |
| 2,642,207 | A | 6/1953 | Renzi |
| 2,819,824 | A | 1/1958 | Ebert |
| 2,968,423 | A | 1/1961 | Mahler et al. |
| 3,129,020 | A | 4/1964 | Bujnowski |
| 3,235,133 | A | 2/1966 | Zimmerman et al. |
| 3,422,998 | A | 1/1969 | Murray |
| 3,434,636 | A | 3/1969 | Kachman |
| D217,330 | S | 4/1970 | Conry |
| 3,543,964 | A | 12/1970 | Schlossmacher |
| 3,595,421 | A | 7/1971 | Sanchis |
| 3,630,419 | A | 12/1971 | Pierce |
| D229,826 | S | 1/1974 | Raptis |
| D254,444 | S | 3/1980 | Levine |
| 4,193,524 | A | 3/1980 | Fleming |
| 4,243,157 | A | 1/1981 | Rettberg |
| 4,267,945 | A | 5/1981 | Maynard, Jr. |
| 4,838,877 | A | 6/1989 | Massau |
| D311,573 | S | 10/1990 | Lewis |
| 5,044,521 | A | 9/1991 | Peckels |
| 5,397,027 | A | 3/1995 | Koch |
| D357,733 | S | 4/1995 | Matkovich |
| 5,449,351 | A | 9/1995 | Zohmann |
| 5,799,836 | A | 9/1998 | Lee |

(Continued)

FOREIGN PATENT DOCUMENTS

| | | |
|---|---|---|
| DE | 001763264 | 3/1958 |

(Continued)

*Primary Examiner*—Lien T Ngo
(74) *Attorney, Agent, or Firm*—Greenberg Traurig, LLP

(57) ABSTRACT

Disclosed is a pouring dispenser for pouring liquid from a bottle, the pouring dispenser incorporating a removable nozzle section.

16 Claims, 12 Drawing Sheets

U.S. PATENT DOCUMENTS

| | | | |
|---|---|---|---|
| 5,961,008 | A | 10/1999 | Peckels |
| D418,417 | S | 1/2000 | Hollinger |
| 6,230,944 | B1 | 5/2001 | Castellano et al. |
| 6,280,424 | B1 | 8/2001 | Chang et al. |
| D465,387 | S | 11/2002 | DuBow |
| D468,205 | S | 1/2003 | Pierce |
| D484,801 | S | 1/2004 | Pierce |
| 6,742,678 | B1 | 6/2004 | Krystopik, Jr. |
| 7,104,469 | B2 | 9/2006 | Merk et al. |
| D533,776 | S | 12/2006 | Allen et al. |
| 7,185,775 | B1 | 3/2007 | Decal |
| 2006/0000855 | A1 | 1/2006 | Allen et al. |

FOREIGN PATENT DOCUMENTS

| | | |
|---|---|---|
| DE | 020211928 | 3/2003 |
| FR | 002742127 | 6/1997 |
| GB | 0103439 | 1/1917 |
| GB | 2 419 586 | 7/2008 |
| JP | 070132983 | 5/1995 |
| WO | WO 2004/101381 | 11/2004 |

DRINK POURING DISPENSER

CROSS-REFERENCE TO RELATED APPLICATIONS

This application is a continuation of U.S. Utility patent application Ser. No. 11/098,180, filed Apr. 4, 2005, now U.S. Pat. No. 7,527,180, which claims priority to Australian Application No. 2004 901795, filed Apr. 2, 2004. The contents of these applications are incorporated herein by reference in their entirety.

BACKGROUND

1. Field

The present invention broadly relates to pouring dispensers and, in particular, to a bottle mounted pouring dispenser for pouring liquids such as liquor. The invention will hereinafter be described with reference to this application. However, it will be appreciated that the invention is not limited to this particular field of use.

2. General Background

Bottle mounted drink pouring dispensers have long been used in the bar and restaurant industry, as well as in the home, for dispensing liquors in a controlled fashion and with minimal spillage. In their simplest construction, such pouring dispensers comprise a cork or other flexible sealing device designed to seal the bottle opening, and a pour nozzle extending from the interior of the bottle through the cork or other scaling device. The nozzle allows fluid communication between the interior of the bottle and the exterior of the bottle. The nozzle is typically bent to facilitate pouring the liquid from the bottle into a container. An airflow vent in fluid communication with the bottle interior and in communication with the atmosphere facilitates pouring, allowing air to enter the bottle from the atmosphere upon liquid being poured from the bottle, equalising the pressure.

Known pouring dispensers comprise a moulded plastic or metal pouring nozzle extending through an annular base portion. The annular base portion comprises a cylindrical extension which fits securely into the neck of the bottle, sealing the bottle. This cylindrical extension is commonly over-fitted with a flexible cork, rubber or other sealing device. This sealing device retains the pouring nozzle and base over the mouth of the bottle during use. The pouring nozzle extends through the annular base portion and cylindrical extension such that the interior of the bottle is in fluid communication with the exterior of the bottle by means of the pouring nozzle. The pouring dispenser is therefore inserted into the neck of a bottle to facilitate pouring from the bottle.

Pouring dispenser cleaning is of particular importance in bars and restaurants. Known pouring dispensers require removal of the entire dispenser for cleaning, leaving the bottle open to the atmosphere or requiring that bottles be covered with plastic wrap or an alternate water impermeable material. This process is time-consuming and not secure. Moreover the need for easy removal of the pouring dispenser from the bottle for the purpose of cleaning means that the pouring dispenser can be knocked off at inopportune times, such as while pouring liquid from the bottle or when the bottle is knocked or dropped.

SUMMARY

According to a first aspect there is provided a pouring dispenser for pouring liquid from a bottle, the pouring dispenser comprising a sleeve adapted to be removably attached with the neck of the bottle, and a pouring nozzle adapted to be removably attached with and extend from the sleeve, such, that the pouring nozzle is in fluid communication with the interior of the bottle.

In one form the sleeve is adapted to be inserted into and extend from the neck of the bottle and to form a liquid-tight seal with the neck of the bottle.

In one form the pouring nozzle is adapted to be inserted into the sleeve and to form a liquid-tight seal with the sleeve.

In one form the pouring nozzle extends through the sleeve.

In one form the sleeve comprises a neck portion, adapted to be inserted into the neck of the bottle, and an annular shoulder portion, adapted to extend from the neck of the bottle.

In one form the pouring nozzle comprises a spout portion, adapted to pour liquids, and an annular base portion. In this form the annular base portion is adapted to be removably connected with the annular shoulder portion.

In one form the pouring nozzle includes an airflow channel, the airflow channel extending from an airflow aperture in the surface of the pouring nozzle into the interior of the bottle. The airflow aperture is elliptical.

In one form the pouring dispenser further comprises a cover which is adapted for use as a measure. The cover is adapted to be removably attached with the sleeve.

In one form the sleeve extends from the neck of the bottle substantially in line with the neck of the bottle.

In one form the cover extends from the sleeve substantially in line with the sleeve.

According to a second aspect there is provided a pouring dispenser for pouring liquid from a bottle, the pouring dispenser comprising a pouring nozzle through which liquid is dispensed, the pouring nozzle being removable from the pouring dispenser.

In one form the pouring nozzle is adapted to form a liquid-tight seal with the neck of the bottle.

In one form the pouring nozzle extends from the interior of the bottle, through the pouring dispenser and is adapted to form a liquid-tight seal with the pouring dispenser.

In one form the pouring dispenser further comprises a neck portion, adapted to be inserted into the neck of the bottle, and an annular shoulder portion, adapted to extend from the neck of the bottle.

In one form the pouring nozzle comprises a spout portion, adapted to pour liquids, and an annular base portion. In this form the annular base portion is adapted to be removably connected with the annular shoulder portion.

In one form the pouring nozzle includes an airflow channel, the airflow channel extending from an airflow aperture in the surface of the pouring nozzle into the interior of the bottle. The airflow aperture is elliptical.

In one form the pouring dispenser further comprises a cover. The cover is adapted for use as a measure and is removably attached with the pouring dispenser.

In one form the pouring dispenser extends from the neck of the bottle substantially in line with the neck of the bottle.

BRIEF DESCRIPTION OF THE DRAWINGS

A preferred embodiment of the invention will now be described, by way of example only, with reference to the accompanying drawings in which.

DETAILED DESCRIPTION OF THE PREFERRED EMBODIMENT

Figure 1:
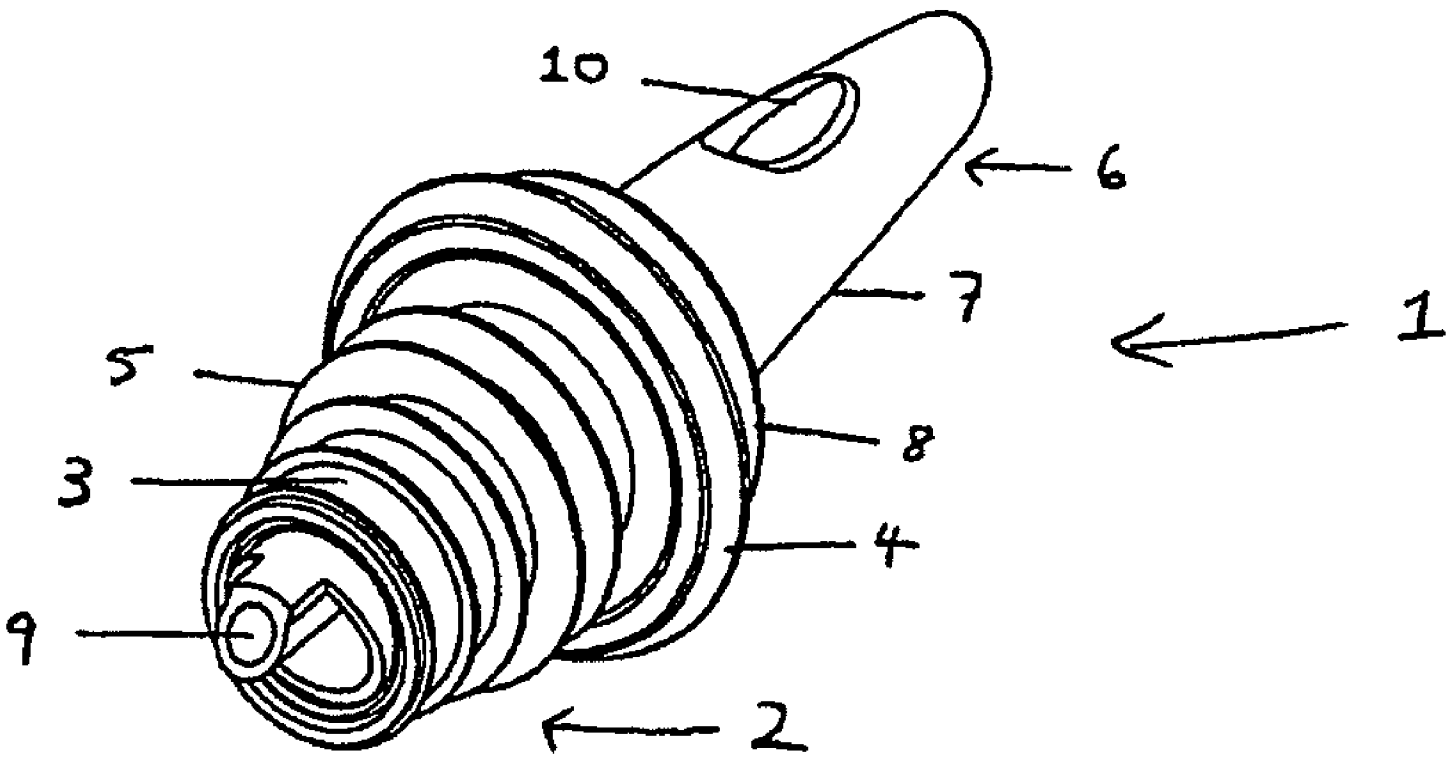
FIG. 1 is a bottom perspective view of a pouring dispenser in accordance with the preferred embodiment.
Figure 2:
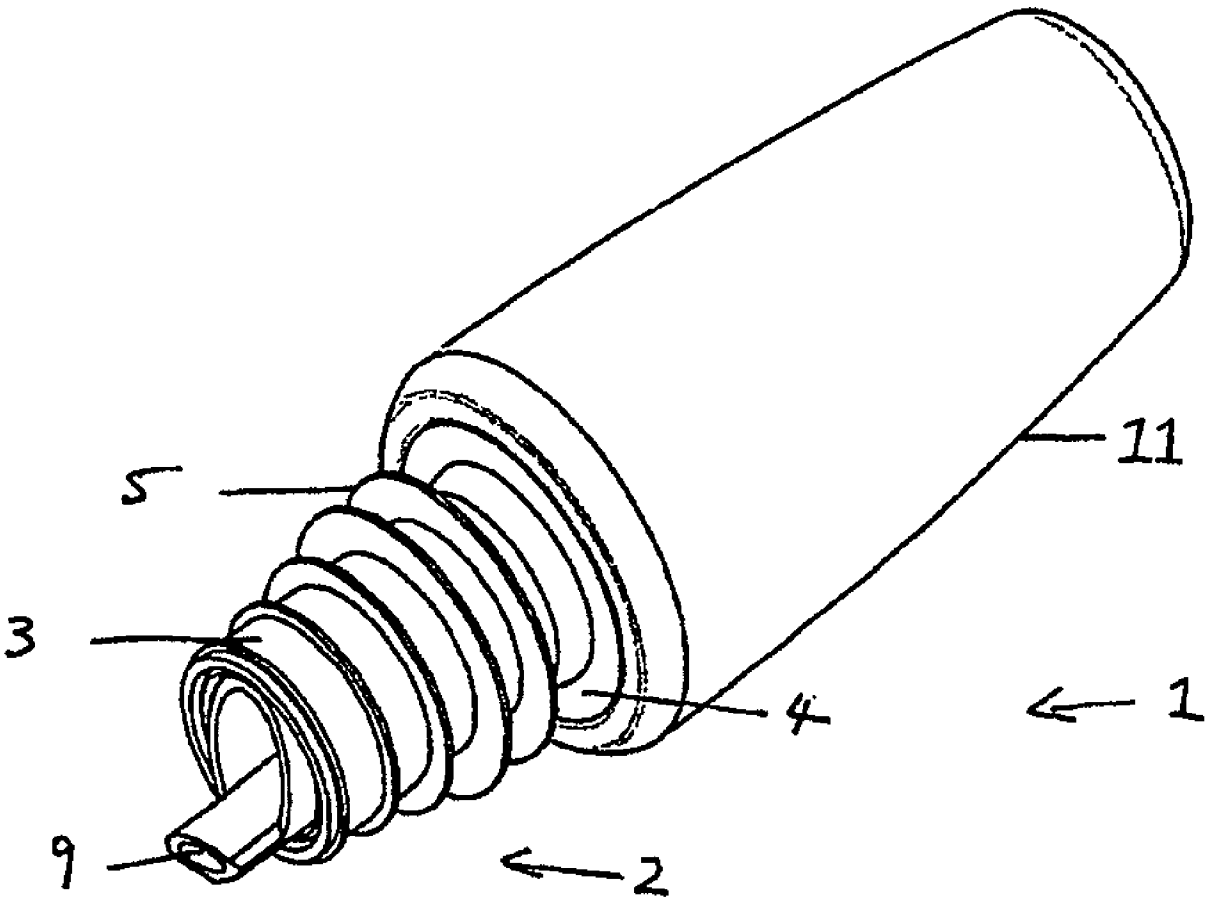
FIG. 2 is a bottom perspective view of the pouring dispenser of FIG. 1, with cover.
Figure 3:
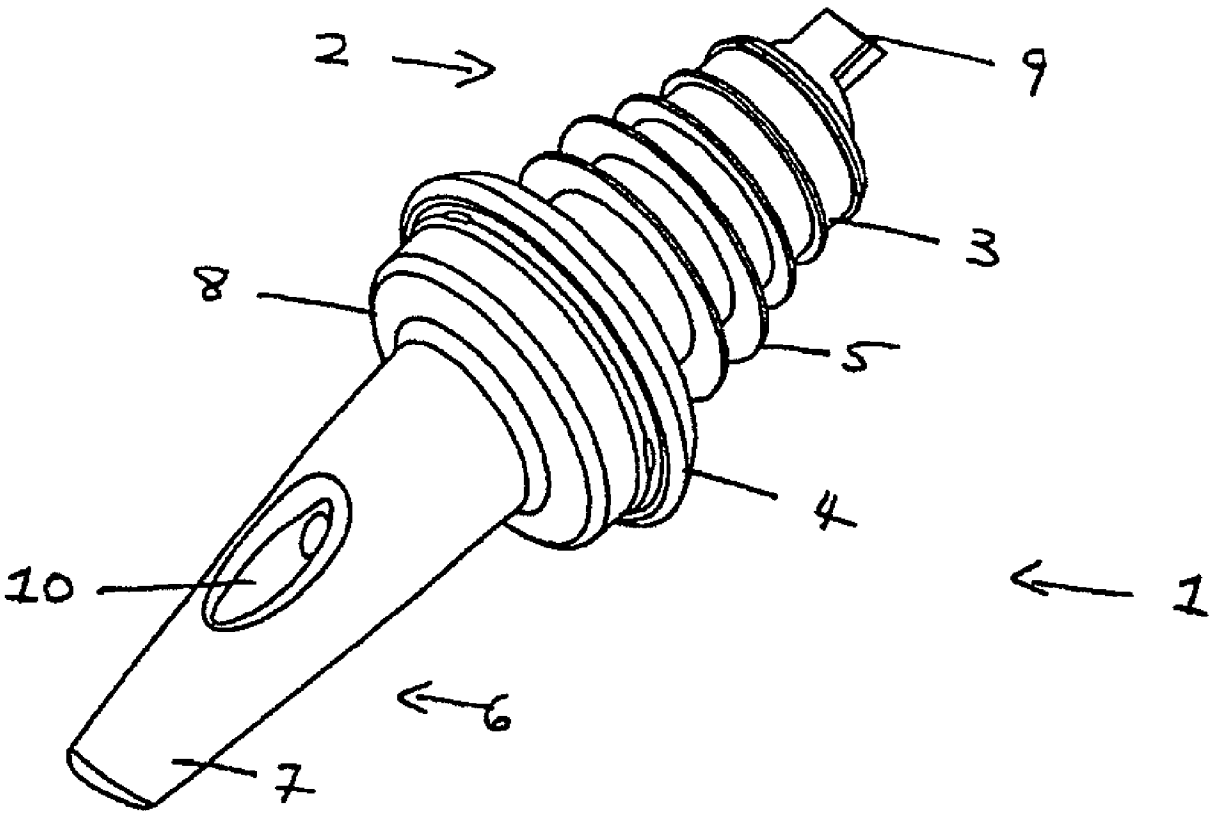
FIG. 3 is a top perspective view of the pouring dispenser of FIG. 1.
Figure 4:
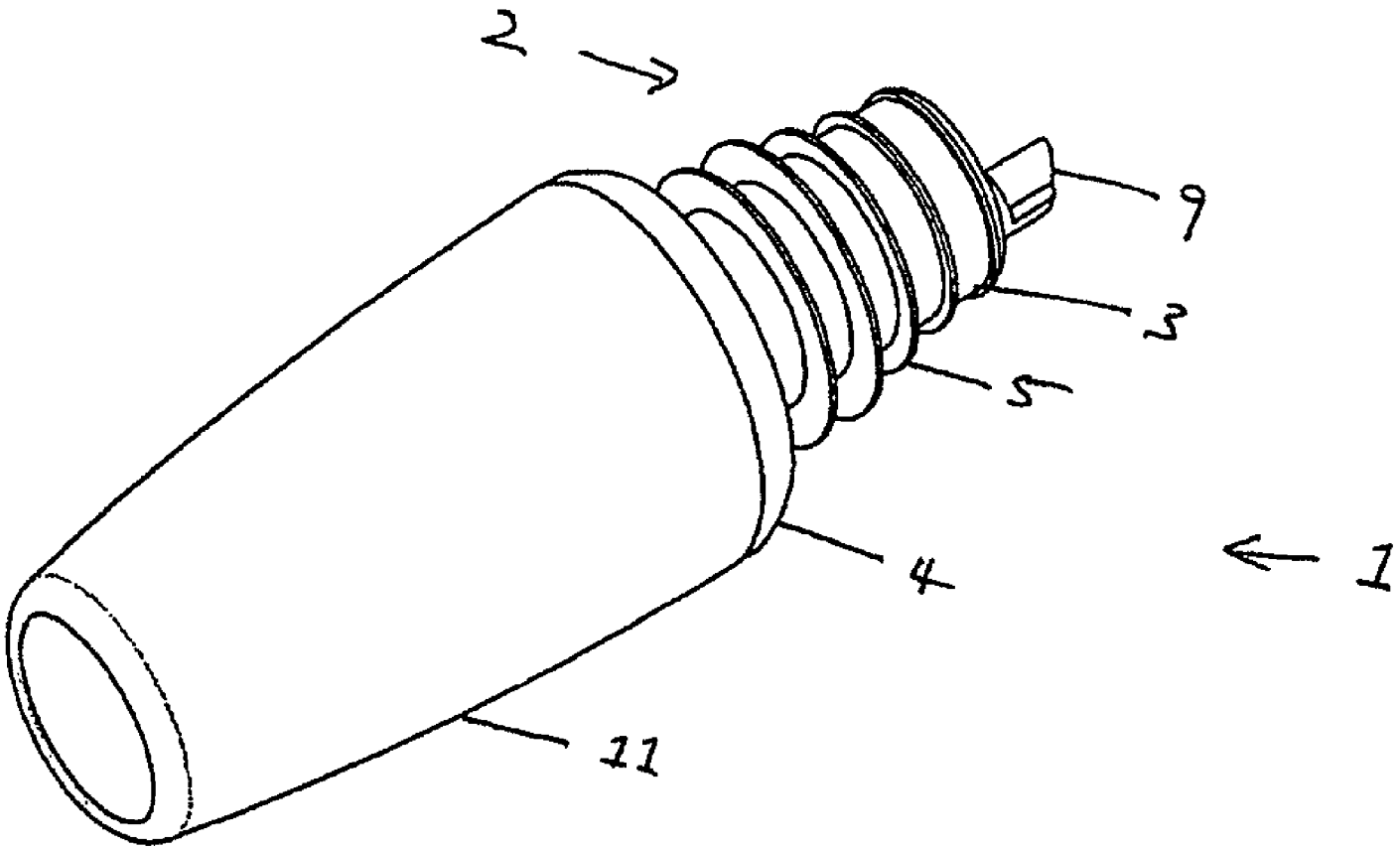
FIG. 4 is top perspective view of the pouring dispenser of FIG. 1, with cover.
Figure 5:
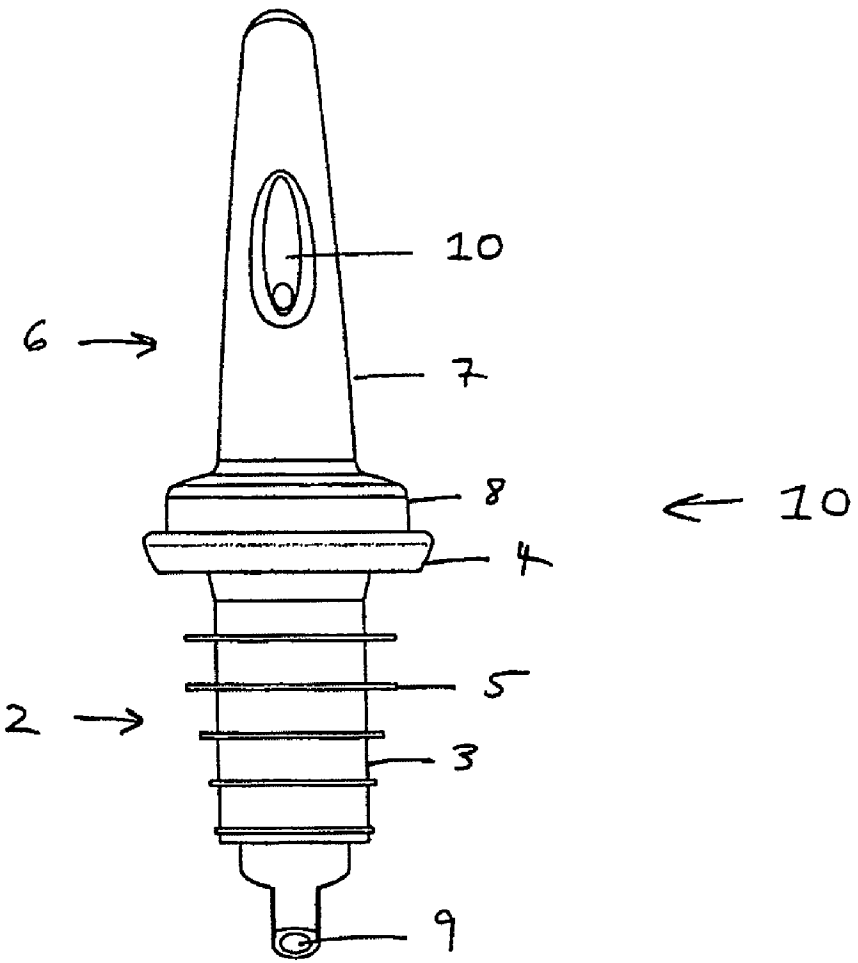
FIG. 5 is a front view of the pouring dispenser of FIG. 1.
Figure 6:
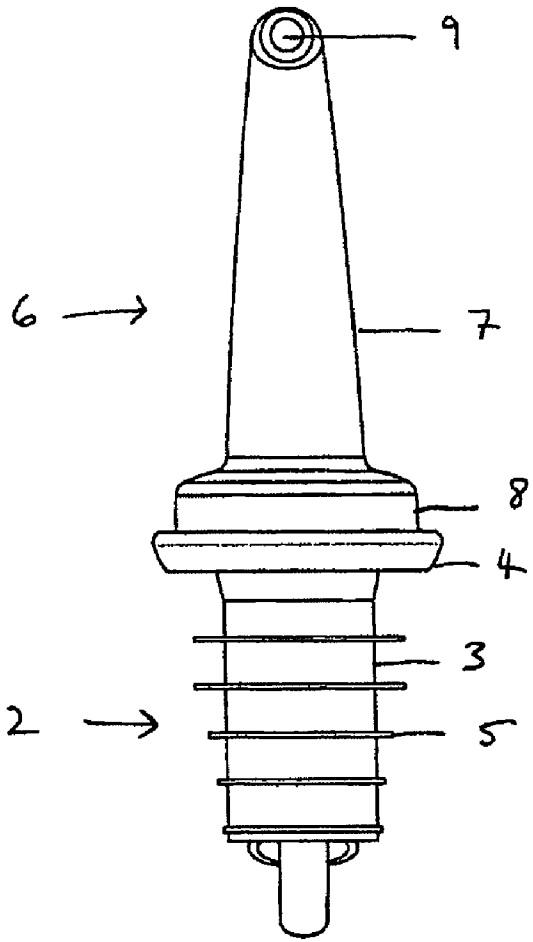
FIG. 6 is a rear view of the pouring dispenser of FIG. 1.
Figure 7:
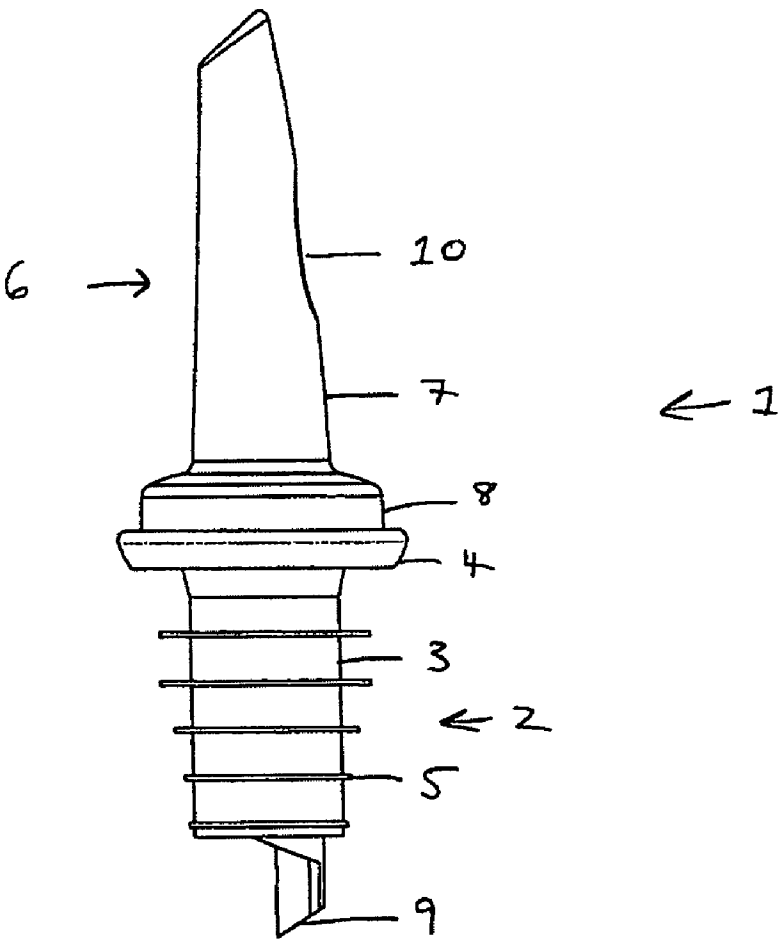
FIG. 7 is a side view of the pouring dispenser of FIG. 1.
Figure 8:
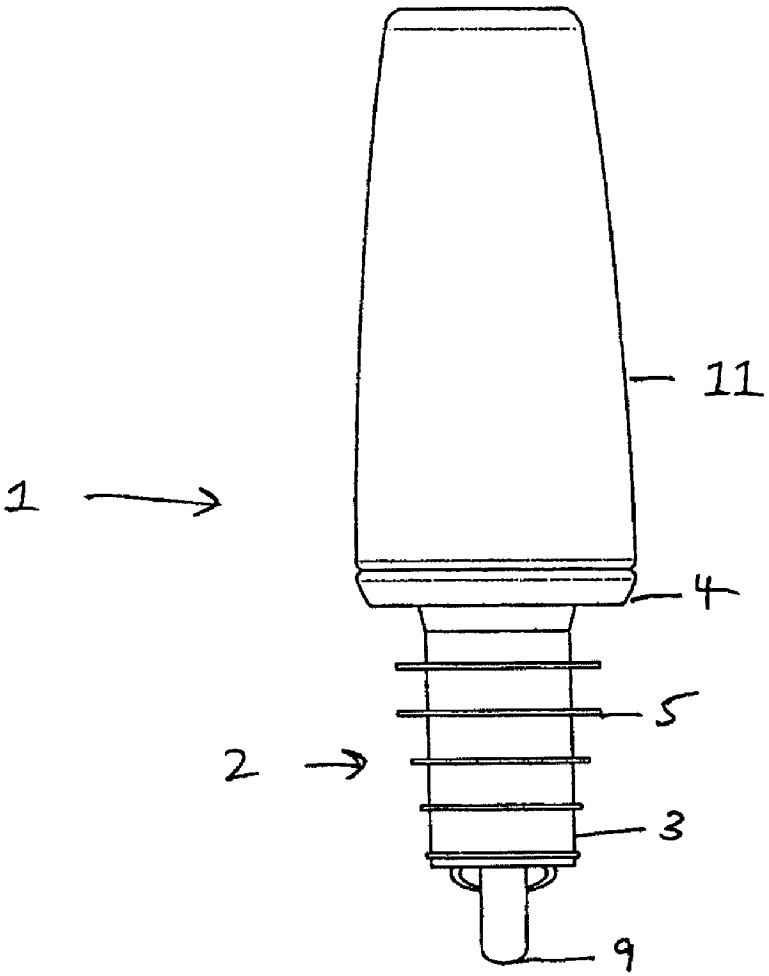
FIG. 8 is a side view of the pouring dispenser of FIG. 1, with cover.
Figure 9:
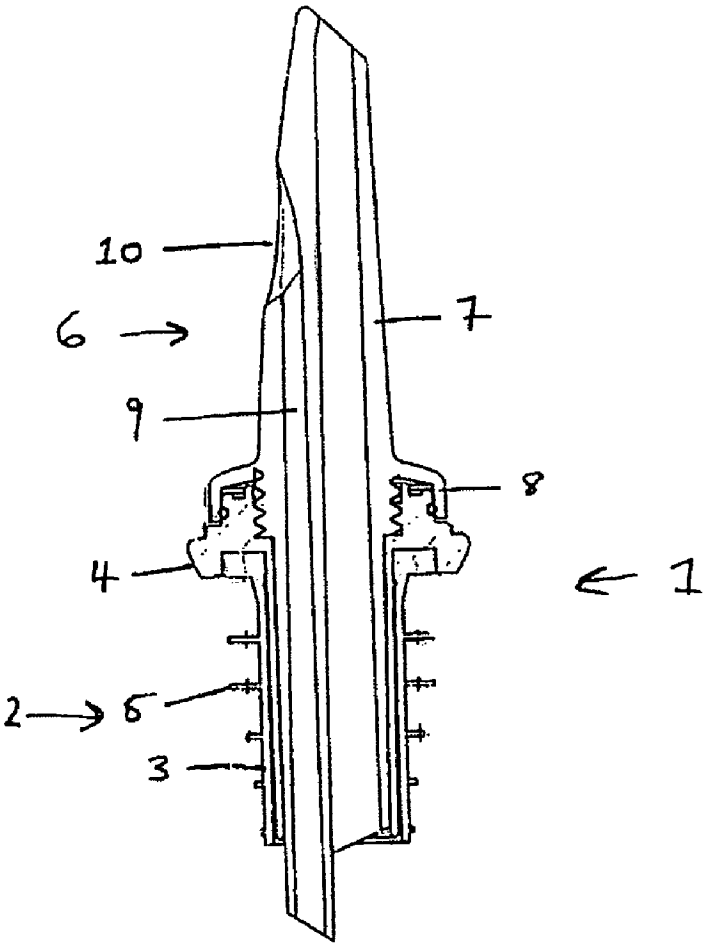
FIG. 9 is a cross-sectional view of the pouring dispenser of FIG. 1.
Figure 10:
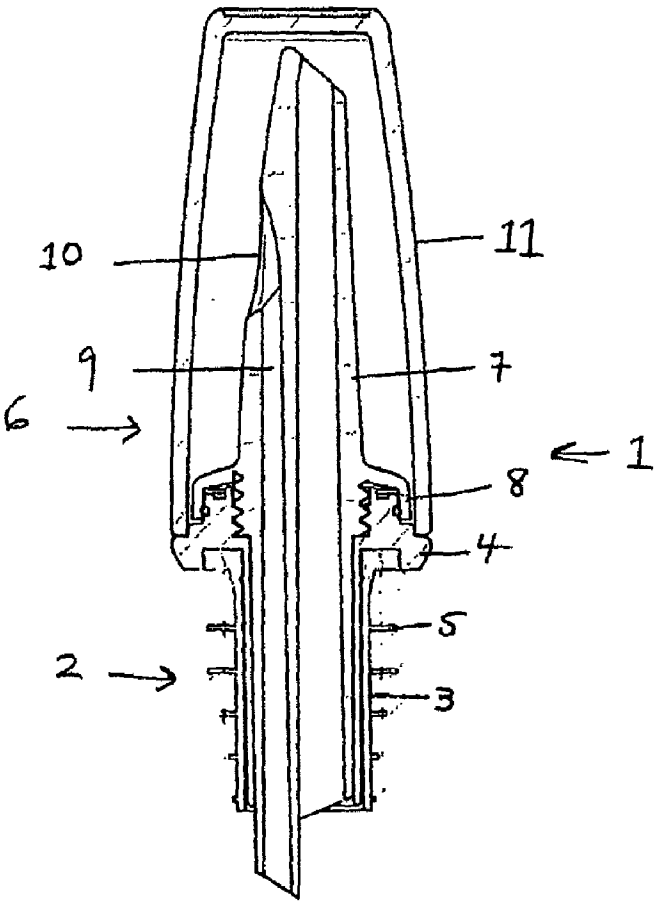
FIG. 10 is a cross-sectional view of the pouring dispenser of FIG. 1, with cover.
Figure 11:
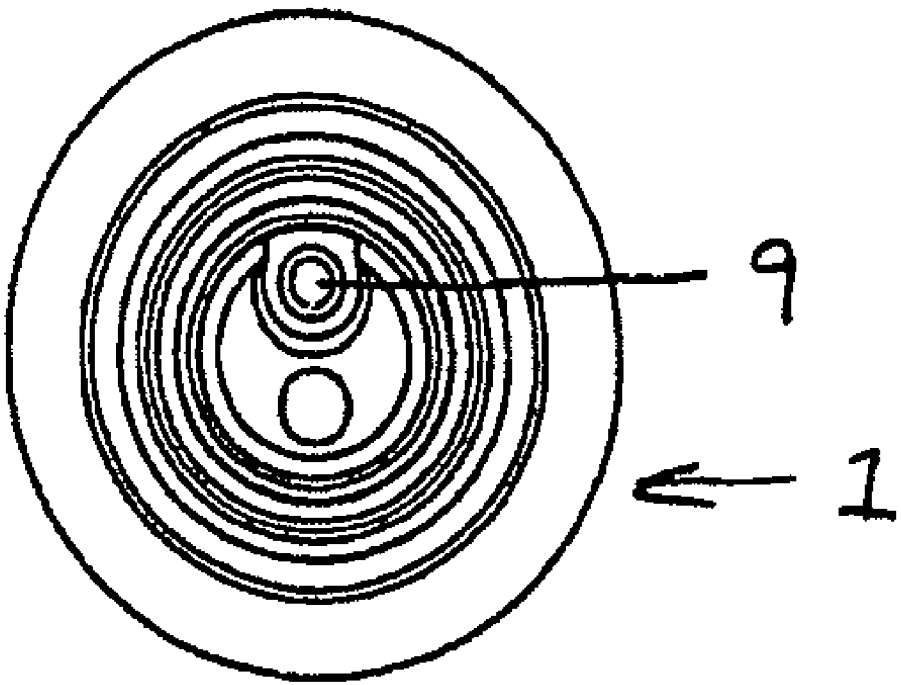
FIG. 11 is a bottom view of the pouring dispenser of FIG. 1.
Figure 12:
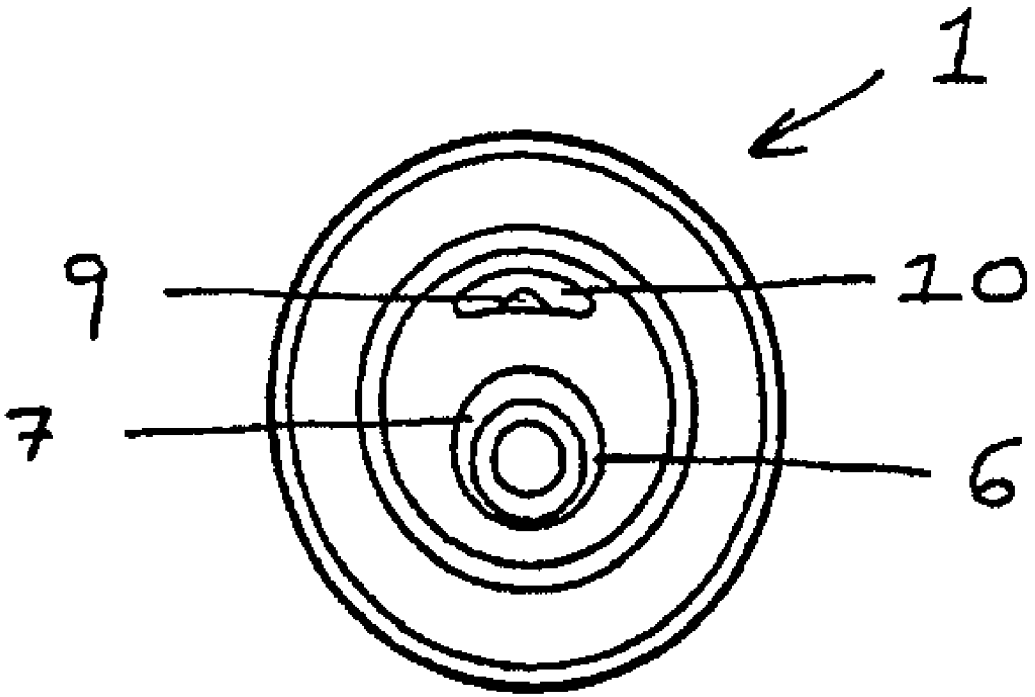
FIG. 12 is a top view of the pouring dispenser of FIG. 1.

FIGS. 1 through 12 depict a pouring dispenser 1 for pouring liquid from a bottle (not illustrated). The pouring dispenser 1 comprises a sleeve 2, the sleeve 2 comprising a cylindrical neck portion 3 and an annular shoulder portion 4. The sleeve 2 is composed of moulded plastic, metal or other material, capable of being formed or moulded. The sleeve, 2 also comprises a sealing portion 5 which over-fits the cylindrical neck portion 3. The sealing portion 5 is composed of a ribbed or flexible material such as rubber or cork.

In use the cylindrical neck portion 3 of the sleeve 2 is adapted to fit inside the neck of the bottle. The sealing portion 5 ensures that the cylindrical neck portion is closely fitted inside the neck of the bottle such that little or no fluid escapes the bottle by flowing around the edges of the cylindrical neck portion 3. The annular shoulder portion 4 is adapted to extend from the bottle and be positioned abutting or proximal to the rim of the bottle neck (not illustrated) such that the pouring dispenser 1 cannot be inserted too far into the bottle. Further, the annular shoulder portion 4 can be utilised as a grip for removing the pouring dispenser 1 from the bottle.

The pouring dispenser 1 also comprises a pouring nozzle 6. The pouring nozzle 6 comprises a spout portion 7 extending through an annular base portion 8. The annular base portion 8 is adapted to be removably attached with the annular shoulder portion 4 of the sleeve 2. In one form the attachment means (not illustrated) is a resistance fit. In another form the attachment means comprises a helical thread extending outwardly from the annular shoulder portion and inwardly from the annular base portion, the thread being adapted to allow the annular base portion 8 to be threadedly attached to the annular shoulder portion 4. In another form the attachment means is a snap fit fastening such as a slight undercut around the full inner circumference of the annular base portion 8 and a slight tapering around the full circumference of the annular shoulder portion 4.

The spout portion 7 of the pouring nozzle 6 is tubular and facilitates the user dispensing a requested volume of liquid from the bottle out into a measure. The volume of liquid is preferably about 30 millilitres. The spout portion 7 is slightly curved to allow for greater pouring ease.

The pouring nozzle 6, also comprises an airflow channel 9 extending from an airflow aperture 10 in the surface of the pouring nozzle 6 to the interior of the bottle. The airflow aperture 10 is elliptical in shape and is positioned close to the annular base 8 of the pouring nozzle 6, such that a user may cover the airflow cavity 10 with a thumb or forefinger in order to better control the flow of liquid through the pouring nozzle 6. The airflow channel 9 is adapted to allow air to flow into the interior of the bottle upon liquid being poured from the bottle such that the pressure in the interior and exterior of the bottle are equalised to allow for greater pouring ease.

The pouring nozzle is composed of moulded plastic, metal or other material capable of being formed or moulded.

In use the pouring nozzle 6 is inserted into the sleeve 2. The annular base portion 8 of the pouring nozzle 6 is removably attached with the annular shoulder portion 4 of the sleeve 2. The pouring nozzle 6 is therefore removable from the sleeve 2. This feature allows for a greater ease of cleaning the pouring nozzle 6 and allows for cleaning the pouring nozzle 6 while leaving sleeve 2 in place.

The pouring dispenser 1 comprises a cover 11. This is clearly illustrated in FIG. 2. The cover 11 is removably attached with the sleeve 2 by means of resistance fit, a threaded helix or a snap fit fastening such as a slight undercut around the full circumference of the sleeve 2 and a slight tapering around the full circumference of the cover 11.

In use, the cover 11 is removed from the pouring dispenser 1 and inverted such that the cover 11 can be utilised as a container for the liquid dispensed from the bottle. The cover 11 is a measure to accurately dispense a particular volume of liquid from the pouring dispenser 1. The cover 11, is adapted to accurately contain 30 mL of liquid or whatever might be a standard measure at the point of sale.

In one form the cover 11 includes gradations to indicate the volume o liquid contained within the inverted cover 11. In another form the cover 11 includes an indicator line or variation in external texture, for example, at a half measure or 15 millilitre measure.

In use the pouring nozzle 6 is removably attached with sleeve 2. When the pouring nozzle 6 is removed from the sleeve 2, cover 11 can still be placed over the sleeve 2 and removably attached with the annular shoulder portion 4 in order to seal the bottle. Thus the pouring nozzle 6 can be removed for cleaning and cover 11 can be used to seal the bottle without needing to resort to plastic wrap or other insecure means of sealing the bottle.

The attachment means (not illustrated) attaching the pouring nozzle 6 with the sleeve 2 is sufficiently stable to ensure that the pouring nozzle 6 is not accidentally separated from the sleeve 2 when the cover it is removed.

The sleeve 2 and the base of the pouring nozzle 6 extend from the bottle (not illustrated) substantially in line with the neck of the bottle. That is the annular shoulder portion 4 has a diameter slightly greater than the diameter of the opening (not illustrated) in the neck of the bottle. This reduces the risk of accidentally removing the pouring dispenser 1 when handling the bottle. The cover 11 extends from the sleeve 2 substantially in line with the annular shoulder portion 4.

The foregoing describes only a preferred embodiment of the present invention and modifications, obvious to those skilled in the art can be made thereto without departing from the scope of the present invention.

The term "comprising", and its grammatical variations, as used herein is used in the inclusive sense of "having" or "including" and not in the exclusive sense of "consisting only of".

We claim:

1. A pouring dispenser for pouring liquid from a bottle, the pouring dispenser comprising:

a sleeve adapted to be removably attached with the neck of the bottle and extend from the neck of the bottle, the sleeve comprising a neck portion, adapted to be inserted into the neck of the bottle, and an annular shoulder portion, adapted to extend from the neck of the bottle, the sleeve being formed as a body with externally directed circumferential ribs, the ribs being spaced apart, and being of different diameters;

a pouring nozzle adapted to be attached with and removable from the annular shoulder portion, such that the pouring nozzle is in fluid communication with the interior of the bottle, wherein the pouring nozzle includes an airflow channel, the airflow channel extending from an elliptical airflow aperture in the surface of the pouring nozzle into the interior of the bottle; the sleeve and annular shoulder portion having a first axial bore, the pouring nozzle having a second axial bore, the first axial bore and the second axial bore being substantially straight and coaxial from an end of both of the respective two bores for location inside the neck to position outside the neck; and the second bore including an inside wall and at least one side of the inside wall of the second bore being straight from end to end of the second bore; and a cover for use as a measure, the cover being removably attached with the sleeve, and wherein the sleeve extends from the neck of the bottle substantially in line with the neck of the bottle; and wherein the cover extends from the sleeve substantially in line with the sleeve.

2. A pouring dispenser as defined in claim 1, wherein the sleeve is adapted to form a liquid-tight seal with the neck of the bottle.

3. A pouring dispenser as defined in any claim 1, wherein the pouring nozzle is adapted to be inserted into the sleeve.

4. A pouring dispenser as defined in claim 3, wherein the pouring nozzle is adapted to form a liquid-tight seal with the sleeve.

5. A pouring dispenser as defined in claim 3, wherein the pouring nozzle extends though the sleeve.

6. A pouring dispenser as defined in claim 1, wherein the pouring nozzle comprises a spout portion, adapted to pour liquids, and an annual base portion.

7. A pouring dispenser as defined in claim 6, wherein the annular base portion is adapted to be removably connected with the annual shoulder portion.

8. A pouring dispenser for pouring liquid from a bottle, the pouring dispenser comprising:

a sleeve adapted to be removably attached with the neck of the bottle and extend from the neck of the bottle, the sleeve comprising a neck portion, adapted to be inserted into the neck of the bottle, and an annular shoulder portion adapted to extend from the neck of the bottle, the sleeve and annular shoulder portion having a first axial bore, the sleeve being formed as a body with externally directed circumferential ribs, the ribs being spaced apart, and being of different diameters;

a pouring nozzle having a second axial bore, the pouring nozzle passing through the sleeve and annular shoulder portion, such that the pouring nozzle is in fluid communication with the interior of the bottle;

the first axial bore and the second axial bore being substantially straight and coaxial from an end of both of the respective two bores for location inside the neck to position outside the neck; and the second bore including an inside wall and at least one side of the inside wall of the second bore being straight from end to end of the second bore;

wherein the pouring nozzle includes an airflow channel, the airflow channel extending from an airflow aperture in the surface of the pouring nozzle into the interior of the bottle; and a cover for use as a measure, the cover being removably attached with the sleeve, and wherein the sleeve extends from the neck of the bottle substantially in line with the neck of the bottle; and wherein the cover extends from the sleeve substantially in line with the sleeve.

9. A pouring dispenser as defined in claim 8 wherein the airflow aperture is elliptical.

10. A pouring dispenser as defined in claim 8 wherein the pouring nozzle includes a wall portion extending from a free end of the nozzle towards a position adjacent the annular sleeve, the wall tapering from a relatively narrower portion to a relatively broader portion adjacent the shoulder.

11. A pouring dispenser as defined in claim 8 wherein the aperture in the airflow channel ends substantially flush with the elliptical aperture and at a position relatively recessed from the outer face of the wall.

12. A pouring dispenser as defined in claim 8 wherein the pouring nozzle includes a peripheral wall, and the tip of the pouring nozzle ends in a transversely cut end of the wall, the transversely cut end being longer on the side of the peripheral wall surface of the pouring nozzle having the aperture and shorter on the opposite side of the peripheral wall.

13. A pouring dispenser as defined in claim 8 wherein the second bore is narrower at the free end remote from the shoulder and gradually increases in diameter towards a position substantially adjacent to the sleeve and thereafter is of a substantially constant diameter.

14. A pouring dispenser as defined in claim 1 wherein the aperture in the airflow channel ends substantially flush with the elliptical aperture and at a position relatively recessed from the outer face of the wall, and wherein the spout includes an outer wall surface, the outer wall surface being a substantially regular surface tapering from the shoulder towards the tip, and the tapering surface line of the surface upstream of the elliptical aperture and downstream of the elliptical aperture, and the elliptical aperture being an only interruption in a continuity of the surface upstream of the elliptical aperture and downstream of the elliptical aperture.

15. A pouring dispenser as defined in claim 8 wherein the aperture in the airflow channel ends substantially flush with the elliptical aperture and at a position relatively recessed from the outer face of the wall, and wherein the nozzle includes an outer wall surface, the outer wall surface being a substantially regular surface tapering from the shoulder towards the tip, and the tapering surface line of the surface upstream of the elliptical aperture and downstream of the elliptical aperture, and the elliptical aperture being an only interruption in a continuity of the surface upstream of the elliptical aperture and downstream of the elliptical aperture.

16. A pouring dispenser for pouring liquid from a bottle, the pouring dispenser comprising:

a sleeve adapted to be removably attached with the neck of the bottle and extend from the neck of the bottle, the sleeve comprising a neck portion, adapted to be inserted into the neck of the bottle, and an annular shoulder portion, adapted to extend from the neck of the bottle, the sleeve being formed as a body with externally directed circumferential ribs, the ribs being spaced apart, and being of different diameters;

a pouring nozzle adapted to be attached with and removable from the annular shoulder portion, such that the pouring nozzle is in fluid communication with the interior of the bottle, wherein the pouring nozzle includes an airflow channel, the airflow channel extending from an elliptical airflow aperture in the surface of the pouring nozzle into the interior of the bottle; and a cover for use as a measure, the cover being removably attached with the sleeve, and wherein the sleeve extends from the neck of the bottle substantially in line with the neck of the bottle; and wherein the cover extends from the sleeve substantially in line with the sleeve wherein the aperture in the airflow channel ends substantially flush with the elliptical aperture and at a position relatively recessed from the outer face of the wall, and wherein the nozzle includes an outer wall surface, the outer wall surface being a substantially regular surface tapering from the shoulder towards the tip, and the tapering surface line of the surface upstream of the elliptical aperture and downstream of the elliptical aperture, and the elliptical aperture being an only interruption in a continuity of the surface upstream of the elliptical aperture and downstream of the elliptical aperture.

* * * * *